US006100019A

United States Patent [19]

Brust et al.

[11] Patent Number: 6,100,019

[45] Date of Patent: Aug. 8, 2000

[54] PROCESS OF CONDUCTING EPITAXIAL DEPOSITION AS A CONTINUATION OF EMULSION PRECIPITATION

[75] Inventors: Thomas B. Brust, Webster; Philip J. Dale, Hamlin; Mark R. Mis, Cheektowaga; Donald L. Black, Webster, all of N.Y.

[73] Assignee: Eastman Kodak Company, Rochester, N.Y.

[21] Appl. No.: 09/292,436

[22] Filed: Apr. 15, 1999

[51] Int. Cl.[7] ..... G03C 1/015; G03C 1/035; G03C 1/047

[52] U.S. Cl. ..... 430/569; 430/567; 430/642

[58] Field of Search ..... 430/567, 569, 430/642

[56] References Cited

U.S. PATENT DOCUMENTS

| | | | |
|---|---|---|---|
| 4,435,501 | 3/1984 | Maskasky | 430/434 |
| 5,494,789 | 2/1996 | Daubendiek et al. | 430/567 |
| 5,503,971 | 4/1996 | Daubendiek et al. | 430/567 |
| 5,573,902 | 11/1996 | Daubendiek et al. | 430/567 |
| 5,576,168 | 11/1996 | Daubendiek et al. | 430/567 |
| 5,582,965 | 12/1996 | Deaton et al. | 430/567 |
| 5,612,175 | 3/1997 | Eshelman et al. | 430/567 |
| 5,612,176 | 3/1997 | Eshelman et al. | 430/567 |
| 5,612,177 | 3/1997 | Levy et al. | 430/567 |
| 5,614,358 | 3/1997 | Wilson et al. | 430/567 |
| 5,614,359 | 3/1997 | Eshelman et al. | 430/567 |

OTHER PUBLICATIONS

J.E. Maskasky "Epitaxial Selective Site Sensitization of Tubular Grain Emulsions" *Journal of Imaging Science*, vol. 32, No. 4, Jul./Aug. 1988.

*Primary Examiner*—Mark F. Huff
*Attorney, Agent, or Firm*—Carl O. Thomas; Andrew J. Anderson

[57] ABSTRACT

A process is disclosed of conducting in a single reaction vessel selective site high chloride epitaxy deposition as a continuation of host high bromide {1111} tabular grain emulsion precipitation. A host tabular grain emulsion is precipitated accounting for 0.05 to 1.5 moles of silver per liter of dispersing medium. Any iodide at the major faces of the tabular grains is uniformly distributed and any iodide in a surface region of the grains amounts to less than 7 mole, based on silver in the surface region. Until epitaxy is formed, pH is held in the range of 3 to 8. Gelatino-peptizer in an amount of 1 to 40 grams per Ag mole is added to the emulsion. Chloride ion in a range of from 0.03 to 0.15 mole per liter is dispersed in the emulsion. pBr is held in the range of from 3.0 to 3.8 until epitaxy is formed. Iodide ion in a concentration of from $5\times10^{-6}$ to $1\times10^{-4}$ mole per square meter of grain surface area is uniformly adsorbed to the major surfaces of the tabular grains.

8 Claims, No Drawings

PROCESS OF CONDUCTING EPITAXIAL DEPOSITION AS A CONTINUATION OF EMULSION PRECIPITATION

FIELD OF THE INVENTION

This invention relates to a process of preparing radiation-sensitive silver halide emulsions useful in photography and radiography.

DEFINITION OF TERMS

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term {111} tabular" in referring to grains and emulsions indicates those in which the tabular grains have parallel major crystal faces lying in {111} crystal planes.

The terms "high bromide" and "high chloride" in referring to grains and emulsions indicates that bromide or chloride, respectively, is present in a concentration greater than 50 mole percent, based on total silver.

In referring to silver halide grains and emulsions containing two or more halides, the halides are named in order of ascending concentrations.

The terms "pH" and "pBr" are defined as the negative logarithms of hydrogen and bromide ion concentrations, respectively, in a liquid medium.

The term "epitaxy" indicates a first crystal lattice structure that derives its orientation from a second, differing (host) crystal lattice structure on which the first crystal lattice structure is grown.

The term "edge region" is employed to indicate that portion of a silver halide grain that lies within 0.2 $\mu$m of an edge of the grain.

The term "surface region" indicates the 40 percent portion of a silver halide grain, based on silver, that lies nearest the surface of the grain.

The term "robust" is employed to indicate that an emulsion remains close to its planned (aim) characteristics, despite inadvertent variances in its preparation.

Pluronic 31R1 is the BASF trademark for $$HO—[CH(CH_3)CH_2O]_x—(CH_2CH_2\mathbf{0})_y—[CH_2(CH_3)CHO]x'—H$$

where x=25, x'=25 and y=7.

*Research Disclosure* is published by Kenneth Mason Publications, Ltd., Dudley House, 12 North St., Emsworth, Hampshire P010 7DQ, England.

BACKGROUND OF THE INVENTION

Joe E. Maskasky, "Epitaxial Selective Site Sensitization of Tabular Grain Emulsions", *Journal of Imaging Science,* Vol. 32, No. 4, July/August 1988, and Maskasky U.S. Pat. No. 4,435,501 (collectively referred to as Maskasky, except as noted) are cumulative reports of the first investigations of the selective siting of high chloride silver halide epitaxy on host high bromide {111} tabular grains. In most of the embodiments disclosed by Maskasky, the epitaxy is selectively directed to the edges of the host tabular grains, including direction in some instances exclusively to the comers of the host tabular grains.

The approach preferred by Maskasky and that subsequently has been adopted by others calls for precipitating a high bromide {111} tabular grain emulsion, washing the emulsion, and then adsorbing a spectral sensitizing dye onto the major faces of the tabular grains. When properly selected, spectral sensitizing dye directs epitaxy to the edges of the tabular grains during subsequent precipitation of high chloride silver halide. After epitaxy has been deposited, the emulsion is chemically sensitized, typically employing sulfur and gold sensitizers and holding the emulsion at an elevated temperature. Other descriptions of spectral sensitizing dye directed epitaxy are provided by Daubendick et al U.S. Pat. Nos. 5,494,789, 5,503,971 and 5,576,168, Deaton et al U.S. Pat. No. 5,582,965, Eshelman et al U.S. Pat. Nos. 5,612,175, 5,612,176 and 5,614,359, and Levy U.S. Pat. No. 5,612,177.

The use of spectral sensitizing dye as a site director for epitaxial deposition has a number of disadvantages. First, the host grains run the risk of being degraded prior to epitaxial deposition by removal from the reaction vessel, washing, and dye addition before commencing epitaxial deposition. Second, reliance on spectral sensitizing dye for epitaxy siting restricts the possible choices of dyes. Third, the spectral sensitizing dye runs the risk of being degraded when heated to elevated temperatures during chemical sensitization.

Although not the preferred approach, Maskasky recognized that selective site epitaxial deposition onto to high bromide {111} tabular grains can be achieved without employing a spectral sensitizing dye. Maskasky recognized that host tabular grains containing greater than 8 mole percent iodide, based on silver, uniformly distributed, contain sufficient iodide to direct high chloride epitaxy in the absence of a spectral sensitizing dye. Unfortunately, this entails surface region iodide levels that are objectionably high for many imaging applications. Non-uniform iodide placements are shown to direct epitaxy, but a large proportion of the surface regions of host grains must exhibit high iodide levels to restrict epitaxy to a limited area of the host grains.

Maskasky (patent), column 65, Example 3B discloses an example of a host silver bromide {111} tabular grain emulsion having silver chloride epitaxy directed to the corners of the tabular grains using only a surface treatment of potassium iodide as a site director. In this example, the silver chloride epitaxy was introduced only after the emulsion had been precipitated and washed. In other words, epitaxy deposition was not conducted in the same reaction vessel as a continuation of the host grain precipitation.

SUMMARY OF THE INVENTION

A process of emulsion preparation comprised of (1) precipitating an emulsion containing an aqueous dispersing medium and silver halide grains comprised of greater than 50 mole percent bromide, based on silver, greater than 50 percent of total grain projected area being accounted for by tabular grains having {111} major faces, and (2) selectively depositing on the tabular grains at their edges silver halide epitaxy comprised of greater than 50 mole percent chloride, based on silver, wherein, while performing steps (1) and (2) in a single reaction vessel, (a) the emulsion precipitated in step (1) accounts for 0.05 to 1.5 moles of silver per liter of the dispersing medium, (b) any iodide at the major faces of the tabular grains is uniformly distributed and any iodide in a surface region accounting for 40 percent of total silver amounts to less than 7 mole percent, based on silver in the surface region, (c) through completion of step (h), the pH of the emulsion is maintained in a range of from 3 to 8, (d) gelatino-peptizer in an amount of from 1 to 40 g per Ag mole is added to the emulsion, (e) chloride ion in a range of from 0.03 to 0.15 mole per liter is dispersed in the emulsion, (f) through completion of step (h), the emulsion is confined to a pBr in a range of from 3.0 to 3.8, (g) iodide ion in a concentration of from $5\times10^{-6}$ to $1\times10^{-4}$ mole per square meter of grain surface area is uniformly adsorbed to the major surfaces of the tabular grains, and (h) silver ion is added to the emulsion at a rate of at least 0.02 mole per minute per mole of total silver in the emulsion to deposit the silver halide epitaxy in an amount of 0.1 to 50 percent of total silver.

The process of emulsion preparation of the invention does not require the addition of spectral sensitizing dye. Thus, undyed emulsions can be prepared for use in recording imaging exposures in spectral regions of native silver halide sensitivity. When spectral sensitizing dye is added to the emulsions of the invention, its introduction can be deferred until after chemical sensitization has been completed. Hence, it is not necessary to subject the spectral sensitizing dye to the elevated holding temperatures commonly encountered during chemical sensitization.

Accomplishing host grain precipitation and epitaxial deposition in a single reaction vessel avoids degrading the host grains prior to epitaxy. It has also been discovered that the particular steps employed result in radiation sensitive emulsions that exhibit superior and unexpected properties. Lower levels of dye desensitization have been observed than when spectral sensitizing dye is employed as a site director. Additionally, microscopic grain examinations have revealed high levels of crystal lattice dislocations adjacent the edge epitaxy. Edge dislocations are art recognized to increase the imaging sensitivity of high bromide {111} tabular grain emulsions (e.g., see Black et al U.S. Pat. No. 5,709,988). Finally, the emulsions produced by the process of the invention have been observed to be robust, particularly when subjected to inadvertent variances in grain sensitizations.

DETAILED DESCRIPTION OF THE INVENTION

The present invention is directed to a process of emulsion preparation starting with precipitation in a reaction vessel of a high bromide {111} tabular grain host emulsion and proceeding in the same reaction vessel to deposit high chloride silver halide epitaxy at the edges of the tabular grains. Epitaxial deposition occurs in the absence of spectral sensitizing dye.

Any conventional batch single-jet or double-jet precipitation technique can be employed to precipitate the host tabular grain emulsion. The host grain emulsions contain high bromide {111} tabular grains serving as host grains for silver halide epitaxy. In a preferred form of the invention the host gains can be provided by any conventional silver bromide {111} tabular grain emulsion. Whereas camera speed emulsions that lack epitaxy normally rely on iodide in high bromide grains to increase speed, the role of epitaxy in grain sensitization can eliminate any necessity of employing iodide to increase imaging sensitivity. Reducing or eliminating iodide increases development rates.

Iodide in the host tabular grains can be useful to increase blue light absorption and/or to enhance interimage effects. When iodide is incorporated in the host grains, it is uniformly distributed over the major faces of the tabular grains. Further, iodide is limited to less than 7 mole percent in the surface regions of the grains—that is, within the portion of the grains nearest the surface that account for 40 percent of total silver forming the grains. The interior of the grains can contain any convenient conventional concentration of iodide, up to the saturation limit of iodide, which is typically taken as 40 mole percent, based on silver. It is often advantageous to form a tabular grain core that contains little or no iodide, followed by the deposition of a high iodide shell before depositing the surface region. In this form, the highest iodide concentrations appear in the host tabular grains as a buried or sub-surface shell. In most instances overall iodide concentrations of the host tabular grains are less than 20 mole percent, typically less than 10 mole percent.

In addition to silver bromide and silver iodobromide host tabular grains, it is possible to incorporate chloride in the host tabular grains. Silver chloride concentrations are preferably limited to less than 30 mole percent and, optimally, less than 10 mole percent, based on total silver. Silver chlorobromide, silver iodochlorobromide and silver chloroiodobromide host tabular grains are contemplated.

Host high bromide {111} tabular grain emulsions can be precipitated by conventional techniques employing or modified to employ halide compositions satisfying the description above. The teachings of the following patents, here incorporated by reference:

LIST HT

Daubendiek et al U.S. Pat. No. 4,414,310;
Abbott et al U.S. Pat. No. 4,425,426;
Wilgus et al U.S. Pat. No. 4,434,226;
Kofron et al U.S. Pat. No. 4,439,520;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Tsaur et al U.S. Pat. No. 5,147,771;

Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840;
Delton U.S. Pat. No. 5,372,927;
Maskasky U.S. Pat. No. 5,604,085;
Reed et al U.S. Pat. No. 5,604,086;
Maskasky U.S. Pat. No. 5,620,840;
Maskasky U.S. Pat. No. 5,667,955;
Maskasky U.S. Pat. No. 5,691,131;
Maskasky U.S. Pat. No. 5,693,459;
Jagannathan et al U.S. Pat. No. 5,723,278;
Maskasky U.S. Pat. No. 5,733,718;
Jagannathan et al U.S. Pat. No. 5,736,312;
Antoniades et al U.S. Pat. No. 5,750,326;
Brust et al U.S. Pat. No. 5,763,151; and
Maskasky et al U.S. Pat. No. 5,792,602.

Contemplated high bromide {111} tabular grain emulsions are those in which the {111 } tabular grains account for greater than 50 percent, preferably at least 70 and optimally at least 90 percent, of total grain projected area. High bromide emulsions in which {111} tabular grains account for substantially all (>97%) of total grain projected area arc disclosed in the patents of List HT cited above and are specifically contemplated. The {111} tabular grains preferably have an average thickness of less than 0.3 $\mu$m and most preferably less than 0.2 $\mu$m. It is specifically contemplated to employ ultrathin tabular grain emulsions in which the tabular grains having an average thickness of less than 0.07 $\mu$m account for greater than 50 percent of total grain projected area. When tabular grain emulsions are relied upon for latent image formation in the blue recording layer unit, they can have the thickness characteristics noted above. However, to increase speed by absorption of blue light (i.e., native absorption) within the grains, it is recognized that the tabular grains having a thickness of up to 0.50 m can account for at least 50 percent of total grain projected area in the blue recording layer units.

The high bromide {111} tabular grains preferably have an average aspect ratio of at least 5, most preferably greater than 8. Average aspect ratios can range up to 100 or higher, but are typically in the range of from 12 to 60. The average ECD of the latent image forming emulsions is typically less than 10 $\mu$m, with mean ECD's of less than 6 $\mu$m being particularly preferred to maintain low levels of granularity.

The grains of the host emulsion are precipitated in an aqueous dispersing medium containing water and a peptizer. Typically peptizer concentrations range from 0.2 to 10 percent, based on the total weight of the emulsion in the reaction vessel. Any conventional hydrophilic colloid peptizer can be employed in the precipitation of the host emulsion grains. Gelatino-peptizers (i.e., gelatin and gelatin derivative peptizers) are preferred. Acetylated and phthalated gelatin are commonly employed gelatin derivatives. Emulsion peptizers are summarized in *Research Disclosure*, Vol. 389, September 1996, Item 38957, II. Vehicles, vehicle extenders, vehicle-like addenda and vehicle related addenda, A. Gelatin and hydrophilic colloid peptizers.

It is additionally contemplated to employ cationic starch as a peptizer for the high bromide {111} tabular grain emulsion. The use of cationic starch as a peptizer for the precipitation of high bromide {111} tabular grain emulsions is taught by Maskasky U.S. Pat. Nos. 5,604,085, 5,620,840, 5,667,955, 5,691,131 and 5,733,718. Oxidized cationic starches are advantageous in exhibiting lower levels of viscosity than gelatino-peptizers. This facilitates mixing.

For conducting epitaxial deposition according to the process of the invention, the silver level in the reaction vessel at the conclusion of precipitation is contemplated to account for 0.05 (preferably 0.1) to 1.5 moles of silver per liter of the dispersing medium. Since the overwhelming majority of emulsion precipitations produce emulsions with silver concentrations within this range, no adjustment of the host grain emulsion is usually required. It is preferred to adjust silver concentrations within the indicated range while precipitation of the host grain emulsion is occurring rather than adding a post-precipitation adjustment step.

The steps undertaken leading to high chloride silver halide epitaxy deposition on the host emulsion grains are conducted with the host grain emulsion held at a pH of from 3 to 8, preferably 5 to 6. Although a pH of 8 is on the alkaline side neutrality, this pH is not high enough to cause ammonium ions to release ammonia, a powerful grain ripening agent.

The steps undertaken leading to high chloride silver halide epitaxy deposition can be conducted at any conventional silver halide precipitation temperature. A convenient preferred range is from 20 to 60° C.

With the host grain emulsion within the silver concentration, temperature and pH ranges noted above, gelatino-peptizer in an amount of from 1 (preferably 5) to 40 (preferably 20) g per Ag mole is added. The gelatin preferably contains measurable levels of methionine, most preferably at least 12 (optimally at least 30), micromoles of methionine per gram. So-called "oxidized" gelatin that contains immeasurably low levels of methionine exhibits a significantly weaker peptizing ability than methionine containing gelatino-peptizer. (For background, refer to Maskasky U.S. Pat. No. 4,713,320.)

The gelatino-peptizer is added for the purpose of assuring a high level of peptizing action. Although peptizer is, of course, in the emulsion as precipitated, these can be weaker peptizers. Further, over extended precipitation times at elevated temperature, the effectiveness of peptizer present during precipitation is degraded.

After gelatino-peptizer addition, chloride ion is added to the host grain emulsion. Chloride ion concentrations in the reaction vessel are contemplated to range from 0.03 to 0.15 mole per liter of emulsion. Chloride ion can be added in the form of an aqueous solution of a soluble salt, such as alkali, alkaline earth or ammonium chloride. The chloride ions are uniformly distributed within the dispersing medium by mixing.

Next the bromide ion concentration in the dispersing medium within the reaction vessel is increased to levels above those employed for high bromide {111} tabular grain emulsion precipitation. This reduces the bromide ion stoichiometric excess in the dispersing medium. pBr is contemplated to be adjusted in the range of from 3.0 to 3.8.

To prepare the host tabular grains for epitaxy restricted to the edges of the host grains, iodide ion in a concentration of from $5\times10^{-6}$ to $1\times10^{-4}$ (preferably $1\times10^{-5}$ to $3\times10^{-5}$) mole per square meter of grain surface area is provided within the dispersing medium within the reaction vessel. The iodide ion is uniformly adsorbed to the major faces of the high bromide {111} tabular grains. Uniform adsorption of iodide ion requires care to distribute uniformly the iodide ion in the dispersing medium before adsorption occurs. This involves stirring of the dispersing medium in the reaction vessel. With rapid stirring iodide ion in the form of a soluble salt, such alkali, alkaline earth or ammonium iodide, can be added to the dispersing medium. These salts immediately dissociate to release iodide ion. Unlike the addition of chloride noted above, iodide ion released immediately adsorbs to grain surfaces within the dispersing medium.

To assure uniformity of iodide ion distribution in the reaction vessel and hence uniform adsorption on the major faces of the high bromide {111} tabular grains, it is recognized that iodide ion can be generated within the reaction vessel after an iodide ion source material has been uniformly distributed. Jagannathan et al U.S. Pat. No. 5,736,312, here incorporated by reference, teaches the release of iodide ions from iodate ($IO_3^-$). Maskasky U.S. Pat. No. 5,858,638, here incorporated by reference, teaches the release of iodide ions from iodine ($I_2$). Takada et al U.S. Pat. No. 5,389,508, here incorporated by reference, teaches introducing iodide into a reaction vessel in the form of a compound satisfying the formula:

$$R\text{–}I \qquad (I)$$

wherein R represents a monovalent organic residue which releases iodide ion upon reacting with a base or a nucleophilic reagent, such as sulfite, acting as an iodide ion releasing agent.

Following iodide adsorption to the major faces of the host tabular grains, silver ion is added to the emulsion at a rate of least 0.02 (preferably 0.04) mole per minute per mole of total silver in the emulsion to deposit high chloride silver halide epitaxy selectively at the edges of the tabular grains. In a specifically preferred form the epitaxy is limited to the portion of the edges that lie at the corners of the grains. In host grain emulsions having high bromide {111 } tabular grains with hexagonal major faces, the high chloride epitaxy can be directed to from 1 to 6 comers of the grains, but, on average, generally from 2 to 5 corner epitaxy sites are present in the host grains. The maximum rate of silver ion addition is limited only by the equipment available to perform the introduction. So called "dump" additions are contemplated—i.e., addition rates that are as nearly instantaneous as available introduction equipment will permit.

Typically silver ion is introduced into the reaction vessel as an aqueous silver nitrate solution. Silver ion in the amount of at least 0.1 percent of total silver is contemplated. All of the silver introduced deposits on the host grains as high chloride silver halide epitaxy. Silver introduction and the resulting epitaxy can range up to 50 percent of total silver, but is preferably limited to no more than 25 percent of total silver. An optimum range of silver introduction and resulting epitaxy is in a range of from 3 to 5 percent of total silver.

At the lower levels of silver ion introduction, the chloride ion previously distributed within the dispersing medium reacts with the silver ion to form the epitaxy. At higher levels of silver ion introduction chloride ion can be concurrently introduced through a separate jet in an aqueous salt solution as described above. Silver in excess of that required to react with all the chloride ion previously introduced can be added in the form of a silver chloride Lippmann emulsion. AgCl average grain sizes of less than 0.3 $\mu$m are contemplated. When the chloride ions are added in the form of fine grains, the peptizer and mixing together uniformly distribute the chloride within the dispersing medium.

When silver ions are introduced along with only chloride ions to generate high chloride silver halide epitaxial deposits, the high chloride silver halide epitaxy will contain greater than 90 mole percent chloride, based on silver in the epitaxy, with small amounts of iodide and/or bromide ions, also present in the reaction vessel, being incorporated. In all instances chloride concentrations in the epitaxial deposits are contemplated to be greater than 50 mole percent, based on silver in the epitaxy.

Dopants can be incorporated in the grains at any time during the precipitation process. The patents cited above to disclose high bromide {111} tabular grain emulsions useful as host emulsions disclose conventional dopant selections that can be placed in these grains. Alternatively, it is possible to place one or more of the dopants in the high chloride silver halide epitaxy. The location of photographically useful dopants in high chloride silver halide epitaxy is disclosed by Olm et al U.S. Pat. No. 5,503,970, the disclosure of which is here incorporated by reference. A simple and convenient way to introduce the dopants into the high chloride silver halide epitaxy is to incorporate the dopants in the silver chloride Lippmann grains. When employing combinations of dopants, improved performance can often be realized by maintaining a spatial separation of the dopants within each grain. It is contemplated to place one or more dopants in the host grains and one or more dopants in the high chloride silver halide epitaxy. It is also contemplated to separate dopants in the host grains by placing them at spaced locations in the host grains.

After the epitaxy has been deposited on the host grains, the emulsions can be further prepared for use in photographic or radiographic elements in any convenient conventional manner. Usually the emulsions are removed from the reaction vessel and washed at the conclusion of the precipitation process. In the process of this invention washing occurs after the epitaxy has been deposited. Emulsion washing techniques are disclosed in *Research Disclosure*, Item 38957, III. Emulsion washing. Alternatively, soluble salts can be removed from the emulsions as they are being formed in the reaction vessel. For example, the ultrafiltration during precipitation techniques taught by Mignot U.S. Pat. No. 4,334,012, here incorporated by reference.

Addition of the high chloride silver halide epitaxy alone significantly increases the sensitivity of the resulting tabular grain emulsions. However, maximum sensitivities are realized when the silver halide epitaxy is combined with subsequent conventional chemical and spectral sensitizations. The high bromide {111} tabular grain emulsions with silver salt epitaxy are preferably chemically sensitized as disclosed in *Research Disclosure*, Vol. 389, September 1996, Item 38957. IV. Chemical sensitization. Middle chalcogen (i.e., sulfur, selenium and tellurium) and noble metal (e.g., gold) chemical sensitizations are preferred. The teachings of Kofron et al U.S. Pat. No. 4,439,520 are here incorporated by reference.

A specifically preferred approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

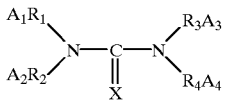

(II)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one A,R, to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra-substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(III)}$$

wherein

L is a mesoionic compound;

X is an anion; and $L^1$ is a Lewis acid donor.

It has been discovered that the emulsions of the invention are less susceptible to desensitization by spectral sensitizing dye than conventional high bromide {111 } tabular grain emulsions with epitaxy. When an emulsion is intended to be exposed to light outside its spectral region of native silver halide sensitivity, such as exposure to green or red light, the emulation exhibits little or no measurable speed when exposed to green or red light in the absence of a spectral sensitizing dye. The adsorption of a green or red absorbing spectral sensitizing dye to the grain surfaces dramatically increases the sensitivity of the emulsion in this spectral region. This docs not mean, however, that the dye has not also desensitized the emulsion. If the speeds of the emulsion in a spectral region of native sensitivity (e.g., the near ultraviolet) with and without spectral sensitizing dye are compared, often the intrinsic speed of the emulsion has been reduced by the addition of spectral sensitizing dye. This loss of intrinsic speed also indicates that all of the potentially available speed increase in the spectral region of spectral sensitization has not been realized. Surprisingly, the emulsions of the invention exhibit lower dye desensitization and higher speeds in both the spectral regions of intrinsic sensitivity and spectral sensitization.

Spectral sensitization is preferably undertaken in the practice of the present invention following chemical sensitization. Spectral sensitization prior to completing formation of the silver halide epitaxy is not contemplated. Useful spectral sensitizing dyes are disclosed in *Research Disclosure*, Item 38957, V. Spectral sensitization and desensitization, A. Sensitizing dyes.

Apart from the features described above, the emulsions prepared by the process of the invention can take any convenient conventional form and can be incorporated into photographic and radiographic elements for use in forming a developable latent image. All of the patents cited above in the HT list, incorporated by reference above, disclose emulsion and imaging element features compatible with the emulsions of the invention and their use. Other conventional imaging element features (including addenda and support elements) as well as conventional exposures and processing are summarized in Research Disclosure, Item 38957.

EXAMPLES

Comparative Example A1

This comparative example repeated the procedures described in Maskasky U.S. Pat. No. 4,435,501, Example 3B. The epitaxial deposits were precipitated without the use of an organic site director after the host grain emulsion had been precipitated and washed.

Preparation of host silver bromide {111} tabular grain emulsion: A 6 liter reaction vessel was charged with an aqueous solution consisting of 1958.9 g of water, 30.0 g (1.5 wt. %) of alkali-processed gelatin, 15.02 g (0.073 m/L) of sodium bromide. At 80° C. and with vigorous stirring, 0.05 M silver nitrate was added at 48.5 mL/min with a 0.3 M sodium bromide solution used to maintain constant excess bromide. The 0.05 M silver nitrate solution was then added using a linearly accelerated flow from 48.5 to 145.5 mL/min over 4 minutes with the 3.0 M sodium bromide solution used to maintain constant excess bromide. A 1.5 M silver nitrate solution was then added using a linearly accelerated flow from 7 to 100 mL/min over 25 minutes with a 1.5 M sodium bromide solution used to maintain constant excess bromide. The 1.5 M silver nitrate solution was then added at 100 mL/min for 6.6 minutes with excess bromide level held constant with the 1.5 M sodium bromide solution. 212 g of phthalated gelatin were added, the emulsion was cooled to 40° C. and washed by the coagulation process of Yutzy and Russell U.S. Patent 2,614,929.

The resulting silver bromide {111 } tabular grain emulsion had a mean grain ECD of 3.77 $\mu$m and a mean grain thickness of 0.105 $\mu$m.

The epitaxial deposits were precipitated as follows: Four moles of the tabular emulsion described above were melted at 40° C. with vigorous stirring. A 0.04 M potassium iodide solution was then added at 5 mL/min for 10 minutes. A 0.04 mole sample of this emulsion was removed and centrifuged at 5000 rpm for 10 minutes. The supernatant was removed, and the emulsion was redispersed in 0.0185 M sodium chloride solution. At 40° C. With vigorous stirring, a 0.5 M silver nitrate solution and a 0.55 M sodium chloride solution were added by double-jet addition at 5 mL/min for 4 minutes.

The resulting emulsion was comprised of tabular grains with 42% of the grains having epitaxial deposits on 4 or more of the grain corners. 30% of the total population had epitaxies on 6 grain comers. At least 1 dislocation was visible at most epitaxial junctions.

Comparative Example A2

This comparative example repeated the procedures described in Maskasky U.S. Pat. No. 4,435,501, Example 3B, except the host silver bromide {111} tabular grain emulsion was replaced with a monodisperse tabular emulsion of similar mean grain diameter that was washed using a conventional ultrafiltration technique.

Preparation of host silver bromide {111} tabular emulsion: An 18 liter reaction vessel was charged with an aqueous solution consisting of 4,460.4 g of water, 2.52 g (0.56 g/L) of alkali-processed low methionine gelatin, 5.56 g (1.235 g/L) of sodium bromide, 1.56 g of a 70.8 wt % methanolic solution of Pluronic 31R1 surfactant, and 17.7 g of 4.0 M nitric acid. At 45° C. and with vigorous stirring, 35.0 mL of a 0.35 M silver nitrate solution were added over one minute followed by a one minute hold. After the hold, 28.0 mL of 3.0 M sodium bromide were added over one minute. The temperature was then raised to 60° C. over a period of 9 minutes. After 8 minutes of this temperature ramp, 49.21 g of a 3.74 M ammonium sulfate solution were added. At the completion of the temperature ramp, 125.04 g of 2.5 M sodium hydroxide were added, and the solution was held for 9 minutes. Following the hold, a 1.5 liter solution containing 150.0 g of alkali processed low methionine gelatin, 30.26 g of citric acid, 87.68 g of a 2.5 M sodium hydroxide solution, and 0.26 g of the 70.8% methanolic solution of Pluronic 31R1 was added and held for 3 minutes. After the hold, 61.6 mL of 3.0 M NaBr were added over 2.67 min followed by a 0.5 minute hold. Afterward, a 0.35 M silver nitrate solution was added using a linearly increasing flow rates from 14.5 to 60.0 mL/min over 10.4 minutes. This was followed by a one minute hold. The linearly increasing flow of 0.35 M silver nitrate was then continued from 60.0 mL/min to 85.0 mL/min over 15.8 min with the 3.0 M sodium bromide solution added at approximately 7.8 to 11.0 mL/min to maintain a constant excess halide level. The 3.0 M sodium bromide solution was then added at 13.9 mL/min for 2 minutes to adjust the excess halide level. Then a 3.0 M silver nitrate solution was added with linearly increasing flow rates from 9.9 to 54.0 mL/min over 71.24 min simultaneously with a 3.0 M sodium bromide solution ramped from approximately 10.6 mL/min to 55.9 mL/min to maintain a constant excess halide level. The addition of 3.0 M silver nitrate was then continued at 54.0 mL/min for 13.72 minutes with the 3.0 M sodium bromide added to maintain a constant excess halide level. This was followed by a temperature ramp to 40° C. over 20 minutes. The emulsion was washed and concentrated by ultrafiltration.

The resulting silver bromide {111} tabular grain emulsion had an a average grain ECD of 4.4 $\mu$m and an average grain thickness of 0.10 $\mu$m.

The Epitaxial deposits were precipitated as follows: A sample of 0.4 mole of the tabular emulsion described above were melted at 40° C. with vigorous stirring. A 0.04 M potassium iodide solution was then added at 5 mL/min for 10 minutes. A sample of 0.04 mole of this emulsion was removed and centrifuged at 5000 rpm for 10 minutes. The supernatant was removed, and the emulsion was redispersed in 0.0185 M sodium chloride solution. At 40° C with vigorous stirring, a 0.5 M silver nitrate solution and a 0.55 M sodium chloride solution were added by double-jet addition at 5 mL/min for 4 minutes.

The resulting emulsion was comprised of high bromide {111} tabular grains. About 3% of the grains had epitaxial deposits on 4 or more of the grain comers, and only 1% had epitaxial depositions on all 6 comers.

Comparative Example A3

This example repeats the procedures described above in comparative Example A2, except the monodisperse host tabular emulsion was washed and concentrated following the procedure of Yutzy and Russell U.S. Pat. No. 2,614,929. The epitaxial deposits are precipitated without the use of an organic site director but after the host precipitation and washing process.

This emulsion was prepared identically to comparative Example A1, except that 676 g of phthalated gelatin were added at the end of the precipitation and a series of pH adjustments and redispersals were made to remove the nitrate salts and concentrate the emulsion as described in Yutzy and Russell U.S. Pat. No. 2,614,929.

The resulting silver bromide {111} tabular grain emulsion had a mean grain ECD of 4.7$\mu$m and a mean grain thickness of 0.097 $\mu$m. The resulting emulsion was comprised of silver bromide {111} tabular grains. Sixty seven percent of the tabular grains had epitaxial depositions on 4 or more corners. Thirty seven percent of the total population had epitaxies on 6 or more corners. Most of the epitaxial junctions had one or more dislocations visible by transmission electron microscopy.

Comparative Example B

This example precipitated the epitaxial deposits after the normal precipitation during the spectrochemical sensitization using spectral sensitizing dye as a site director.

A well-stirred reaction vessel was charged with an aqueous solution containing 0.5 g/L alkali-processed low methionine gelatin, 0.6267 g/L sodium bromide and 0.032 g/L of a 70.8 wt % methanolic solution of Pluronic 31R1 surfactant. The temperature was adjusted to 30° C., and pH was adjusted to 1.80 with 4.0 M nitric acid. Then a 0.5 M silver nitrate solution and a 0.54 M sodium bromide solution were added simultaneously at a matched molar addition rate for one minute accounting for 0.08 % of the total silver. This was followed by the addition of a 1.0 M sodium bromide solution to increase the excess halide by 0.022 mole/L. The temperature was then increased to 60° C. over 15 minutes. The solution was then held for 9 minutes. A 66.7 g/L solution of alkali-processed low methionine gelatin was added to increase the volume by 28.4%, and the pH was adjusted to 5.5 with a 2.5 M sodium hydroxide solution. Solutions of 0.5 M silver nitrate and the 0.54 M sodium bromide were then added at 94% of the nucleation flow rate for 20 minutes to add an additional 1.5% of the total silver. The bromide salt solution was varied to maintain a constant excess halide. A 2.75 M silver nitrate solution and a salt solution containing 2.79 M sodium bromide and 0.279 M sodium chloride were then added with a linearly increasing flow ramp accounting for an additional 35% of the total silver. These solutions were than added at a constant flow rate for an additional 31 minutes to complete the precipitation. Again the bromide salt solution was allowed to vary to maintain a constant excess halide level. The emulsion was washed and concentrated by ultrafiltration, and additional bone gelatin was added to a concentration of 40 g/mole.

The resulting silver bromide {111} tabular emulsion had a mean grain ECD of 3.7 $\mu$m by image analysis of electron micrographs and a mean grain thickness of 0.08 $\mu$m, determined from specific surface area measurements.

The epitaxial deposits were formed as follows: A 0.15 mole sample of the above emulsion was added to a well-stirred vessel at 40° C. The pBr of the emulsion was adjusted to 4.05 with a 0.05 M silver nitrate solution. A 2.66 mL amount of 3.764 M sodium chloride was added, followed by the addition of 0.0064 mole of silver iodide Lippman emulsion. A matched molar addition of 0.5 M silver nitrate and 0.5 M sodium bromide was then done to add an additional 0.0025 M of silver. This is followed by the addition of 0.585 mmol of red light absorbing sensitizing dye A [anhydro-5,5'-dichloro-9-ethyl-3,3'-di(3-sulfopropyl) thiacarbocyanine hydroxide] and 0.146 mmol of red light absorbing sensitizing dye B [anhydro-9-5,'6'-dimethoxy-5-phenyl-3'-(3-sulfobutyl)-3-(3-sulfopropyl) oxothiacarbocyanine hydroxide] as premixed gelatin dispersions containing 6% bone gelatin. This was followed by a 20 minute hold. To the reaction vessel were then added 2.23 mL of 3.764 M sodium chloride, 23.14 mL of 0.5 M sodium bromide and 7.44 mL of a 1 mg/mL solution of potassium hexacyanoruthenate. An additional 0.8 mole of silver iodide Lippman grains were then added, followed by 38.4 mL of 0.5 M silver nitrate added over 1.67 minutes.

A silver bromide {111} tabular grain emulsion was provided in which at least 75% of the tabular grains had 4 or more epitaxial deposits at their comers, but dislocations at the junction of the epitaxy and the host grain were visible at only about 4% of the epitaxial junctions.

Example C

This example demonstrates the precipitation of a large sized low dispersity silver bromide {111} tabular grain with 0.75 mole % iodide added to direct highly uniform silver chlorobromide epitaxial deposits to the grain corners. The epitaxial deposits were made during the course of the normal precipitation before the washing or sensitization process and without the use of organic site directors.

An 18 liter reaction vessel was charged with an aqueous solution ting of 4,460.4 g of water, 2.52 g (0.56 g/L) of alkali-processed low methionine gelatin, 5.56 g (1.235 g/L) of sodium bromide, 1.56 g of a 70.8 wt % methanolic solution of Pluronic 31R1 surfactant, and 17.7 g of 4.0 M nitric acid. At 45° C. and with vigorous stirring, 35.0 mL of a 0.35 M silver nitrate solution were added over one minute, followed by a one minute hold. After the hold, 28.0 mL of 3.0 M sodium bromide were added over one minute. The temperature was then raised to 60° C. over a period of 9 minutes. After 8 minutes of this temperature ramp, 49.21 g of a 3.74 M ammonium sulfate solution were added. At the completion of the temperature ramp, 125.04 g of 2.5 M sodium hydroxide were added, and the solution was held for 9 minutes. Following the hold, a 1.5 liter solution containing 150.0 g of alkali processed low methionine gelatin, 30.26 g of citric acid, 87.68 g of a 2.5 M sodium hydroxide solution, and 0.26 g of the 70.8% methanolic solution of Pluronic 31R1 were added and held for 3 minutes. After the hold, 61.6 mL of 3.0 M NaBr were added over 2.67 min, followed by a 0.5 minute hold. Afterward, a 0.35 M silver nitrate solution was added using linearly increasing flow rates of from 14.5 to 60.0 mL/min over 10.4 minutes. This was followed by a one minute hold. The linearly increasing flow of 0.35 M silver nitrate was then continued from 60.0 mL/min to 85.0 mL/min over 15.8 min with the 3.0 M sodium bromide solution added at approximately 7.8 to 11.0 mL/min to maintain a constant excess halide level. The 3.0 M sodium bromide solution was then added at 13.9 mL/min for 2 minutes to adjust the excess halide level. Then a 3.0 M silver nitrate solution was added with linearly increasing flow rates of from 9.9 to 54.0 mL/min over 71.24 min simultaneously with a 3.0 M sodium bromide solution ramped from approximately 10.6 mL/min to 55.9 mL/min to maintain a constant excess halide level. The addition of 3.0 M silver nitrate was then continued at 64.0 mL/min for 13.72 minutes with 3.0 M sodium bromide added to maintain a constant excess halide level. This was followed by a 10 minute hold in which 272.7 g of an aqueous solution containing 35% gelatin was added and allowed to disperse. This was followed by a temperature ramp to 40° C. over 20 minutes, followed by the addition of 364.29 g of a 3.674 M sodium chloride solution during a one minute hold. A 3.0 M silver nitrate was then added at 40 mL/min for 3 minutes followed by the addition of a 0.26 M potassium iodide solution at 33.5 mL/min for 10 minutes. The amount of 24.45 g of a 3.5 g/L solution of potassium hexacyanoruthenate was then added over one minute. This was followed by the addition of 233.3 mL of 3.0 M silver nitrate over 1 minute. Additional sodium chloride was then added, and the emulsion was washed and concentrated by ultrafiltration, followed by the addition of 222 g of bone gelatin for storage.

The resulting silver bromide {111} tabular emulsion had an average grain ECD of 4.15 μm and an average grain thickness of 0.114 μm. A total 84% of the tabular grain population exhibit high chloride epitaxy on 4 or more of the grain corners. About 70% of the total tabular grain population exhibited 6 epitaxial depositions per grain. One or more dislocations were visible at about 60% of the epitaxial junctions.

A summary of grain characteristics is provided in Table I.

TABLE I

| Example | Grain Diameter And Thickness | Wash method | % of grains with 4 or more epitaxies | % of grains with 6 epitaxies |
|---|---|---|---|---|
| A1(comp) | 3.8 by 0.1 μm | Iso | 42 | 30 |
| A2(comp) | 4.4 by 0.1 μm | UF | 3 | 1 |
| A3(comp) | 4.7 by 0.1 μm | Iso | 67 | 37 |
| C(invent) | 4.2 by 0.11 μm | UF | 84 | 69 |

Iso - denotes the wash method of Yutzy and Russell U.S. Pat. 2,614,929.
UF - denotes washing using ultrafiltration

Example D

This examples demonstrates the precipitation of a moderate sized low dispersity silver bromide tabular grain with 0.75 mole % iodide, based on silver, added to direct the highly uniform high chloride epitaxial deposits to the host grain corners. The epitaxial deposits were made during the course of the normal precipitation before the washing or sensitization process and without the use of organic site directors.

An 18 liter reaction vessel was charged with an aqueous solution consisting of 4,458.9 g of water, 4.50 g (1.0 g/L) of alkali-processed low methionine gelatin, 5.56 g (1.235 g/L) of sodium bromide, 1.56 g of a 70.8 wt % methanolic solution of Pluronic 31R1 surfactant (61.9 wt % based on total silver used in nucleation), and 18.5 g of 4.0 M nitric acid. At 45° C. and with vigorous stirring, 65.1 mL of a 0.50 M silver nitrate solution (5.53 g of silver nitrate) were added over one minute, followed by a one minute hold. After the hold, 25.5 mL of 3.5 M sodium bromide (9.18 g of sodium bromide) were added over one minute followed again by a one minute hold. The temperature was then raised to 60° C. over a period of 9 minutes. After 7 minutes of this temperature ramp 49.13 g of a 3.74 M ammonium sulfate solution was added. At the completion of the temperature ramp, 125.2 g of 2.5 M sodium hydroxide were added and the solution was held for 9 minutes. Following the hold, a 1.5 liter solution containing 150.1 g of alkali processed low methionine gelatin, 30.29 g of citric acid, 87.59 g of a 2.5 M sodium hydroxide solution, and 0.26 g of the 70.8% methanolic solution of Pluronic 31R1 was added and held for 3 minutes. After the hold, 58 mL of 3.5 M NaBr were added over 4 minutes, followed by a 2 minute hold. Afterward, a 0.50 M silver nitrate solution was added using a linearly increasing flow rates from 14.5 to 60.1 mL/min over 10.4 minutes. This was followed by a one minute hold. The linearly increasing flow of 0.5 M silver nitrate was then continued from 60.1 mL/min to 85.1 mL/min over 15.8 min with the 3.5 M sodium bromide solution added at approximately 9.2 to 13.0 mL/min to maintain a constant excess halide level. Then a 3.5 M silver nitrate solution was added with linearly increasing flowrates from 12.4 to 67.5 mL/min over 71.24 min simultaneously with a 3.5 M sodium bromide solution ramped from approximately 12.9 mL/min to 68.8 mL/min to maintain a constant excess halide level. The addition of 3.5 M silver nitrate was then continued at 67.6 mL/min for 13.72 minutes with the 3.5 M sodium bromide added to maintain a constant excess halide level. This was followed by a 10 minute hold in which 272.7 g of an aqueous solution containing 35% gelatin were added and allowed to dissolve. This was followed by a temperature ramp to 40° C. over 20 minutes. This was followed by the addition of 380.26 g of a 3.674 M sodium chloride solution during a one minute hold. The 3.5 M silver nitrate was then added at 50 mL/min for 3 minutes followed by the addition of a 0.38 M potassium iodide solution at 30.5 mL/min for 10 minutes. An amount of 33.82 g of a 3.5 g/L solution of potassium hexacyanoruthenate was then added over one minute. This was followed by the addition of 262.1 mL of 3.5 M silver nitrate over one minute. Additional sodium chloride was then added, and the emulsion was washed and concentrated by ultrafiltration, followed by the addition of 385 g of bone gelatin for storage.

The resulting silver bromide {111} tabular emulsion had an average grain ECD of 2.5 μm and an average grain thickness of 0.122 μm. The grain population was comprised of 72% {111} tabular grains with high chloride epitaxy formed on 4 or more of the grain comers. About 50% of the total grain population was comprised of {111} tabular grains with 6 corner epitaxy sites. One or more dislocations were visible adjacent at least 50% of the epitaxial junctions.

Example E

This is an example of a large thin silver bromide {111} tabular emulsion with 1.2 mole % iodide, based on silver, added to direct the highly uniform high chloride epitaxial deposits formed during the normal precipitation process without organic site directors. In this example the epitaxial deposits were on the major faces of the tabular grains at the grain comers.

An 18 liter reaction vessel was charged with an aqueous solution consisting of 5950 g of water, 3.0 g (0.5 g/L) of alkali-processed low methionine gelatin, 3.76 g (1.235 g/L) of sodium bromide, 0.42 g of a 70.8 wt % methanolic solution of Pluronic 31R1 surfactant (61.9 wt % based on total silver used in nucleation), and 18.5 g of 4.0 M nitric acid. At 30° C. and with vigorous stirring, 14.3 mL of a 0.35 M silver nitrate solution and 14.3 mL of a 0.35 M sodium bromide solution were added over one minute followed by a 30 second hold. After the hold, 68.5 mL of 1.679 M sodium bromide were added over 30 seconds. The temperature was then raised to 60° C. Over a period of 18 minutes. Following the hold, a 1.5 liter solution containing 100 g of alkali processed low methionine gelatin, and 0.10 g of the 70.8% methanolic solution of Pluronic 31R1 were added and held for 2 minutes. An amount of 49.44 g of 2.5 M sodium hydroxide solution were then added during a 2 min hold. After the hold, a 0.35 M silver nitrate solution was added using a linearly increasing flow rates from 14.5 to 57.1 mL/min over 15 minutes with a 0.35 M sodium bromide solution used to maintain constant excess bromide. A 1.6 M silver nitrate solution was then added using a linearly accelerated flow from 12.3 to 69.9 mL/min over 70 minutes with a 1.679 M sodium bromide solution used to maintain constant excess bromide. The 1.6 M silver nitrate solution was then run in at a constant flow of 69.9 mL/min over 20 minutes with the 1.679 M sodium bromide solution used to control excess bromide. This was followed by a 10 minute hold in which 272.7 g of an aqueous solution containing 35% gelatin were added and allowed to dissolve. This was followed by a temperature ramp to 40° C. over 20 minutes, then the addition of 380.26 g of a 3.674 M sodium chloride solution during a one minute hold. A 3.5 M silver nitrate was then added at 50 mL/min for 3 minutes, followed by the addition of a 0.38 M potassium iodide solution at 25 mL/min for 10 minutes. An amount of 16.9 g of a 3.5 g/L solution of potassium hexacyanoruthenate was then added over one minute. This was followed by the addition of 262.1 mL of 3.5 M silver nitrate over 30 seconds. Additional sodium chloride was then added, and the emulsion was washed and concentrated by ultrafiltration, followed by the addition of 385 g of bone gelatin for storage.

The resulting silver bromide {111} tabular grain emulsion had an average grain ECD of 3.6 μm and an average grain thickness of 0.08 μm. Approximately 75% of the grain population was comprised of silver bromide {111} tabular grains with high chloride epitaxy on the major face of the grain restricted to locations adjacent 4 or more of the grain corners. Dislocations were visible adjacent at least 50% of the epitaxial junctions.

Example F

This examples demonstrates the precipitation of a low dispersity silver bromoiodide {111} tabular grain emulsion with highly uniform high chloride epitaxial deposits restricted to the grain corners. In addition to the iodide in the host grains, which was not relied upon to direct epitaxy, iodide was added after host grain formation at 0.75 mole %, based on silver, to direct the epitaxial deposits during the course of the normal precipitation before the washing or sensitization process. No organic site directors were used.

This emulsion was precipitated identically to Example D, except for the following changes: The initial flow of 0.5 M silver nitrate was reduced to 48 mL/min. A 0.7 M potassium iodide solution was added, starting after 30 percent of total host silver had been introduced and ending after 52.5 of total host silver had been introduced to create an internal local iodide concentration of ten mole percent, based on silver. The 0.7 M potassium iodide solution was also added in place of the 0.38 M potassium iodide solution to direct the epitaxial deposition.

The resulting silver iodobromide {111} tabular emulsion had an average grain ECD of 3.08 μm and an average grain thickness of 0.152 μm. Approximately 75% or more of the grain population was comprised of silver iodobromide {111} tabular grains with high chloride epitaxy restricted to 4 or more of the grain corners.

Example G

This examples demonstrates the precipitation of a low dispersity silver bromoiodidc {111} tabular grain emulsion with highly uniform high chloride epitaxial deposits restricted to the grain corners. In addition to the iodide in the host grains, which was not relied upon to direct epitaxy, iodide was added after host grain formation at 0.75 mole %, based on silver, to direct the epitaxial deposits during the course of the normal precipitation before the washing or sensitization process. No organic site directors were used.

This emulsion was precipitated identically to Example D, except for the following changes. The initial flow of 0.5 M silver nitrate was reduced to 48 mL/min. The 0.38 M potassium iodide solution was added during the second and third growth segments (from 5 to 90 mole % of silver addition) at a flow rate to produce a local iodide concentration of 2.65 mole %, based on silver.

The resulting silver iodobromide {111} tabular emulsion had an average grain ECD of 1.5 μm and an average grain thickness of 0.294 μm. At least 50% of the tabular grain population was comprised of tabular grains with high chloride epitaxy restricted to 4 or more of the host grain corners.

Example H

This example differed from Example G in that silver iodide Lippmann grains were used as the source of iodide for incorporation in the host tabular grains.

This emulsion was precipitated identically to in Example D, except for the following changes: The initial flow of 0.5 M silver nitrate was reduced to 48 mL/min. During the second and third growth segments (from 5 to 90 mole % of silver addition), an additional stream of silver iodide Lippman emulsion was added at a flow rate to produce a local iodide concentration of 2.65 mole %, based on silver.

The resulting silver iodobromide {111} tabular grain emulsion had an average grain ECD of 1.46 μm and an average grain thickness of 0.312 μm. At least 50% of the tabular grain population was comprised of grains with high chloride epitaxy restricted to 4 or more of the grain corners.

The invention has been described in detail with particular reference to certain preferred embodiments thereof, but it will be understood that variations and modifications can be effected within the spirit and scope of the invention.

What is claimed is:

1. A process of emulsion preparation comprised of (1) precipitating an emulsion containing an aqueous dispersing medium and silver halide grains comprised of greater than 50 mole percent bromide, based on silver, greater than 50 percent of total grain projected area being accounted for by tabular grains having {111} major faces, and (2) selectively depositing on the tabular grains at their edges silver halide epitaxy comprised of greater than 50 mole percent chloride, based on silver, WHEREIN, while performing steps (1) and (2) in a single reaction vessel, (a) the emulsion precipitated in step (1) accounts for 0.05 to 1.5 moles of silver per liter of the dispersing medium, (b) any iodide at the major faces of the tabular grains is uniformly distributed and any iodide in a surface region accounting for 40 percent of total silver amounts to less than 7 mole percent, based on silver in the surface region, (c) after step (1) and through completion of subsequent steps (d)–(h) below, the pH of the emulsion is maintained in a range of from 3 to 8, (d) gelatino-peptizer in an amount of from 1 to 40 g per Ag mole is added to the emulsion, (e) chloride ion in a range of from 0.03 to 0.15 mole per liter is dispersed in the emulsion, (f) through completion of steps (g) and (h) below, the emulsion is confined to a pBr in a range of from 3.0 to 3.8, (g) iodide ion in a concentration of from $5\times10^{-6}$ to $1\times10^{-4}$ mole per square meter of grain surface area is uniformly adsorbed to the major faces of the tabular grains, and (h) silver ion is added to the emulsion at a rate of at least 0.02 mole per minute per mole of total silver in the emulsion to deposit the silver halide epitaxy in an amount of 0.1 to 50 percent of total silver.

2. A process according to claim 1 wherein the emulsion provided in step (1) accounts for from 0.1 to 1.5 moles of silver per liter of the dispersing medium.

3. A process according to claim 1 wherein the pH maintained through steps (d)–(h) is in the range of from 5 to 6.

4. A process according to claim 1 wherein the gelatino-peptizer contains at least 30 micromoles of methionine per gram.

5. A process according to claim 1 wherein the gelatino-peptizer added in step (d) is introduced in an amount of from 5 to 20 g per Ag mole.

6. A process according to claim 1 wherein iodide ion is adsorbed to the major faces of the tabular grains in a concentration of from $5\times10^{-6}$ to $1\times10^{-4}$ mole per square meter of grain surface area.

7. A process according to claim 1 wherein the silver ion added in step (h) is added at a rate of 0.04 to 0.2 mole per minute per mole of total silver in the emulsion.

8. A process according to claim 1 wherein the emulsion is maintained at a temperature in the range of from 20 to 60° C. during steps (d) through (h).

* * * * *